United States Patent [19]

Kiener

[11] Patent Number: 4,678,597

[45] Date of Patent: Jul. 7, 1987

[54] CHEMICAL CLEANING SOLUTION AND METHOD

[75] Inventor: Michael A. Kiener, Denville, N.J.

[73] Assignee: AM International, Inc., Chicago, Ill.

[21] Appl. No.: 840,182

[22] Filed: Mar. 17, 1986

[51] Int. Cl.[4] ..... C11D 7/54; C11D 7/18

[52] U.S. Cl. ..... 252/100; 134/3; 134/22.16; 134/22.19; 134/38; 134/41; 134/42; 252/80; 252/87; 252/94; 252/95; 252/106; 252/142

[58] Field of Search ..... 252/80, 87, 94, 95, 252/100, 106, 142; 134/3, 22.16, 22.19, 41, 42, 38

[56] References Cited

U.S. PATENT DOCUMENTS

| | | | |
|---|---|---|---|
| T973,008 | 8/1978 | Kaplan et al. | 134/3 |
| 3,072,502 | 1/1963 | Alfano | 134/3 |
| 3,607,759 | 9/1971 | Barth | 252/95 |
| 3,732,170 | 5/1973 | Demangeon | 252/95 |
| 3,738,867 | 6/1973 | Franz | 134/2 |
| 3,900,337 | 8/1975 | Beck et al. | 134/3 |
| 3,968,048 | 7/1976 | Bolan | 134/3 |
| 3,988,254 | 10/1976 | Mori | 252/99 |
| 3,997,459 | 12/1976 | Bogie et al. | 252/99 |
| 4,021,264 | 5/1977 | Knorre et al. | 252/100 |
| 4,452,643 | 6/1984 | Martin et al. | 134/3 |
| 4,459,217 | 7/1984 | Bogie | 252/99 |

*Primary Examiner*—Robert A. Wax

*Attorney, Agent, or Firm*—Nicholas A. Camasto; John R. Hoffman; James P. Zeller

[57] ABSTRACT

A chemical cleaning composition consisting essentially of water, a hydroxycarboxylic acid and a peroxymonosulfate compound is useful for cleaning processing tanks used in silver halide based photographic processing systems.

28 Claims, No Drawings

CHEMICAL CLEANING SOLUTION AND METHOD

BACKGROUND OF THE INVENTION

1. Field of the Invention

This invention relates generally to chemical cleaning compositions and, more particularly, this invention relates to aqueous chemical solutions for cleaning photographic processing tanks and trays.

2. Description of Related Art

Rendering visible camera or otherwise exposed silver-based photographic materials conventionally requires a three bath process: develop, fix and wash, Contact with these solutions can be performed manually, e.g. in trays, or by a mechanized conveyance, e.g. rollers or belts to carry the photographic material from one tank to the next. Such automatic devices, referred to herein as processors, normally have the tanks adjacent and contiguous.

After substantial use of the processor, deposits are formed in the various tanks and conveyance means which are detrimental to processor performance and output quality. These deposits consist variously of some or all of the following: metallic silver and silver salts in the developer tank; silver salts and alkali metal salts in the fixer tank; alkali metal salts, algae/fungal deposits ("bioslime"), gelatin and gelatin by-products in the wash tank.

The prior art utilizes a different solution composition for cleaning each tank. The developer tank requires a strong oxidizer/silver solvent system. Commonly employed agents are chromic acid salts with sulfuric or sulfamic acid. An alkali bisulfite solution "neutralizer" is needed to remove residual chromate salts after the first solution is used. Chromium is a priority pollutant, designated by the U.S. EPA (Environmental Protection Agency), and also classified by the EPA as a "known human carcinogen".

The fixer tank cleaning process employs a strong caustic solution, e.g. caustic soda or caustic potash, to dissolve the salts and silver complexes. Not only is the caustic solution injurious to skin and eyes, the mixing of the chromic acid developer tank cleaner and the caustic fixer tank cleaner may result in a strongly exothermic and potentially violent reaction.

Growth of algae and fungi is very common in the wash tanks of these processors. The accumulation of gelatin and the soluble and insoluble salts create an ideal growth medium. A chlorine bleach, e.g., calcium hypochlorite solution (Clorox®), is commonly employed for this "bioslime" removal. Although effective, except for dissolution of the salt deposits, in cleaning the wash tank, the well known incompatibility of the strong caustic (from the adjacent fixer tank) and "liquid bleach" can produce volumes of deadly gaseous chlorine if mixed.

SUMMARY OF THE INVENTION

It is an object of the invention to overcome one or more of the problems described above.

According to the invention, a chemical cleaning composition for photographic processors is provided. The chemical cleaning composition consists essentially of a solution of water, a hydroxycarboxylic acid, and a peroxymonosulfate compound. The cleaning composition may be used in various photographic processors, such as wash tanks, fixer tanks and developer tanks, by simply varying the concentration of the active components of the composition.

In addition to cleaning compositions, the invention comprehends methods of cleaning the working surfaces of silver halide based photo processing tanks and methods for the removal of various deposits from such surfaces.

Other objects and advantages of the invention will be apparent to those skilled in the art from the following detailed description taken in conjunction with the appended claims.

DETAILED DESCRIPTION OF THE INVENTION

According to the invention, a chemical cleaning composition useful for cleaning photographic processors is provided. The cleaning composition is a solution consisting essentially of water, a hydroxycarboxylic acid and a peroxymonosulfate compound.

Any effective hydroxycarboxylic acid may be used in the practice of the present invention. Hydroxycarboxylic acids that have been tested and have been found useful in the practice of the present invention include citric acid and tartaric acid, with citric acid being preferred.

The peroxymonosulfate compound sold under the designation Oxone® (trademark of E. I. duPont de Nemours Company) has been found useful in the practice of the present invention. The Oxone® product contains the active ingredient potassium peroxymonosulfate which is a highly preferred peroxymonosulfate compound for use in the practice of the present invention.

Neither active component of the composition works well alone as a cleanser, but the mixture of the components in an aqueous solution results in a very effective cleaning composition.

In the invention, the hydroxycarboxylic acid is a very effective chelating agent for mineral salts in the very highly acidic environment of the peroxymonosulfate compound.

In tests done on silver halide based photographic processors, it has been found that it is necessary only to provide sufficient Oxone® in the cleaning composition to permit the removal of silver deposits from developer processors. The relative proportions of the active components may then be adjusted empirically.

It is generally preferable that the composition contain at least about 20 weight percent and no more than about 75 weight percent of the hydroxycarboxylic acid, based on the total weight of the hydroxycarboxylic acid and peroxymonosulfate compound. The presence of too much hydroxycarboxylic acid may slow the oxidizing process and thus render the cleaning process too time consuming and thus uneconomical. A composition wherein the hydroxycarboxylic acid and the peroxymonosulfate compound are in a substantially one-to-one weight ratio is highly preferred.

The composition of the present invention is an ecologically safe cleanser useful in all three processor tanks conventionally used in silver halide based photo processing system. The composition can be used in photographic processor wash tanks, fixer tanks and/or developer tanks simply by varying the total concentration of the active components in the composition.

For use in a photographic wash processor, a total concentration of the hydroxycarboxylic acid and peroxymonosulfate compound in a one-to-one weight ratio of at least about 13 grams per liter of solution is preferred and has been found effective in removing calcium and magnesium salt deposits as well as algae-fungal deposits.

For use in a photographic processor fixer tank, a total concentration of hydroxycarboxylic acid and peroxymonosulfate compound in a one-to-one weight ratio of at least about 26 grams per liter of solution is preferred and has been found effective in removing calcium, magnesium and aluminum salt deposits.

For use in a photographic processor developer tank, a total concentration of hydroxycarboxylic acid and peroxymonosulfate compound in a one-to-one weight ratio of at least about 40 grams per liter of solution is preferred and has been found effective in removing calcium and magnesium salt deposits as well as silver deposits.

The cleaning of a surface is accomplished simply by contacting the surface with the aqueous cleaning solution containing the desired concentration of active ingredients. Such cleaning is easily accomplished with an overnight soaking of the surface desired to be cleaned with an effective concentration of the cleaning composition of the present invention.

The composition and method of the invention is applicable to photographic processors generally, including those known in the art as "RC Processors", those sold under the trademark "Headliner" by Varityper (East Hanover, N.J.) as well as X-ray processors. The invention is generally not applicable to stabilization processors.

The composition of the invention is safe and nontoxic. The need for highly toxic ingredients of prior art compositions, such as thiourea (a suspected carcinogen) is eliminated.

The foregoing detailed description is given for clearness of understanding only, and no unnecessary limitation should be understood therefrom, as modifications within the scope of the invention will be obvious to those skilled in the art.

I claim:

1. A chemical cleaning composition for photographic processors, consisting of a solution of:
   a hydroxycarboxylic acid and
   a peroxymonosulfate compound dissolved in water wherein said hydroxycarboxylic acid comprises between about 20 weight percent and 75 weight percent of the total weight of said hydroxycarboxylic acid and said peroxymonosulfate compound and said peroxymonosulfate compound is present in a sufficient concentration to dissolve silver deposits in a photographic processor developer tank.

2. The composition of claim 1 wherein said hydroxycarboxylic acid is selected from the group consisting of citric acid and tartaric acid.

3. The composition of claim 1 wherein said peroxymonosulfate compound comprises potassium peroxymonosulfate.

4. The composition of claim 1 wherein said hydroxycarboxylic acid and said peroxymonosulfate compound are present in a substantially one-to-one weight ratio.

5. The composition of claim 4 for use in a photographic processor wash tank wherein the total concentration of said hydroxycarboxylic acid and said peroxymonosulfate compound is at least about 13 grams per liter of solution.

6. The cleaning composition of claim 4 for use in a photographic processor fixer tank wherein the total concentration of said hydroxycarboxylic acid and said peroxymonosulfate compound is at least about 26 grams per liter of solution.

7. The cleaning composition of claim 4 for use in a photographic processor developer tank and wherein the total concentration of said hydroxycarboxylic acid and said peroxymonosulfate compound is at least about 40 grams per liter of solution.

8. A chemical cleaning composition for photographic processors, consisting essentially of an aqueous solution of:
   water;
   an acid selected from the group consisting of citric acid and tartaric acid; and,
   a peroxymonosulfate compound,
   wherein said hydroxycarboxylic acid comprises between about 20 weight percent and about 75 weight percent of the total weight of said hydroxycarboxylic acid and said peroxymonosulfate compound and said peroxymonosulfate compound is present in a sufficient concentration to dissolve silver deposits in a photographic processor developer tank.

9. The composition of claim 8 wherein said hydroxycarboxylic acid and said peroxymonosulfate compound are present in a substantially one-to-one weight ratio.

10. The composition of claim 9 for use in a photographic processor wash tank wherein the total concentration of said hydroxycarboxylic acid and said peroxymonosulfate compound is at least about 13 grams per liter of solution.

11. The cleaning composition of claim 9 for use in a photographic processor fixer tank wherein the total concentration of said hydroxycarboxylic acid and said peroxymonosulfate compound is at least about 26 grams per liter of solution.

12. The cleaning composition of claim 9 for use in a photographic processor developer tank wherein the total concentration of said hydroxycarboxylic acid and said peroxymonosulfate compound is at least about 40 grams per liter of solution.

13. The cleaning composition of claim 8 wherein said hydroxycarboxylic acid is citric acid and said peroxymonosulfate compound is potassium peroxymonosulfate.

14. The cleaning composition of claim 13 wherein said citric acid and said potassium peroxymonosulfate are present in said solution in approximately a one-to-one weight ratio.

15. The cleaning composition of claim 14 wherein the total concentration of said citric acid and said potassium peroxymonosulfate is at least about 13 grams per liter of solution.

16. A method of cleaning a working surface of a silver halide based photographic processing tank, comprising:
   contacting said working surface with an aqueous cleaning solution consisting of water, a hydroxycarboxylic acid, and a peroxymonosulfate compound wherein said peroxymonosulfate compound is present in a sufficient concentration to dissolve silver deposits in a photographic processor developer tank and said hydroxycarboxylic acid comprises between about 20 weight percent and about 75 weight percent of the total weight of said hydroxycarboxylic acid and said peroxymonosulfate compound.

17. The method of claim 16 wherein said hydroxycarboxylic acid is selected from the group consisting of citric acid and tartaric acid.

18. The method of claim 16 wherein said peroxymonosulfate compound comprises potassium peroxymonosulfate.

19. The method of claim 16 wherein said hydroxycarboxylic acid and said peroxymonosulfate compound are present in a substantially one-to-one weight ratio.

20. The method of claim 19 for use in a photographic processor wash tank wherein the total concentration of said hydroxycarboxylic acid and said peroxymonosulfate compound in said water is at least about 13 grams per liter of solution.

21. The method of claim 19 for use in a photographic processor fixer tank wherein the total concentration of said hydroxycarboxylic acid and said peroxymonosulfate compound in said water is at least about 26 grams per liter of solution.

22. The method of claim 19 for use in a photographic processor developer tank wherein the total concentration of said hydroxycarboxylic acid and said peroxymonosulfate compound is at least about 40 grams per liter of solution.

23. A method of cleaning a working surface of a silver halide based photo processing tank, comprising:

contacting said working surface with an aqueous cleaning solution consisting essentially of water, an acid selected from the group consisting of citric acid and tartaric acid, and a peroxymonosulfate compound, said hydroxycarboxylic acid comprising between about 20 weight percent and about 75 weight percent of the total weight of said hydroxycarboxylic acid and said peroxymonosulfate compound.

24. The method of claim 23 wherein said peroxymonosulfate compound is present in a sufficient concentration to dissolve silver deposits in a photographic processor developer tank.

25. The method of claim 24 wherein said hydroxycarboxylic acid and said peroxymonosulfate compound are present in a substantially one-to-one weight ratio.

26. The method of claim 25 for use in a photographic processor wash tank wherein the total concentration of said hydroxycarboxylic acid and said peroxymonosulfate compound is at least about 13 grams per liter of solution.

27. The method of claim 25 for use in a photographic processor fixer tank wherein the total concentration of said hydroxycarboxylic acid and said peroxymonosulfate compound is at least about 26 grams per liter of solution.

28. The method of claim 25 for use in a photographic processor developer tank wherein the total concentration of said hydroxycarboxylic acid and said peroxymonosulfate compound is at least about 40 grams per liter of solution.

* * * * *